US006118408A

United States Patent [19]

Yang et al.

[11] Patent Number: 6,118,408

[45] Date of Patent: Sep. 12, 2000

[54] COMPOSITE ANTENNA FOR RADIO TRANSCEIVERS

[75] Inventors: Ching Shan Yang, Hsin-Chuang; Cheng Yin-Shiang, Taipei; Chen Chao-Cheng, Hsin-Tien, all of Taiwan

[73] Assignee: Acer Peripherals Inc., Taoyuan, Taiwan

[21] Appl. No.: 09/005,555

[22] Filed: Jan. 12, 1998

[51] Int. Cl.[7] ..... H01Q 1/24

[52] U.S. Cl. ..... 343/702; 343/715; 343/906

[58] Field of Search ..... 343/702, 715, 343/901, 906, 900; H01Q 1/24

[56] References Cited

U.S. PATENT DOCUMENTS

| | | | |
|---|---|---|---|
| 4,090,030 | 5/1978 | Lagasse | 174/153 |
| 4,220,955 | 9/1980 | Frye . | |
| 4,867,698 | 9/1989 | Griffiths | 439/317 |
| 5,357,262 | 10/1994 | Blaese | 343/906 |
| 5,557,287 | 9/1996 | Pottala . | |
| 5,668,561 | 9/1997 | Perrotta . | |
| 5,739,790 | 4/1998 | Green, Jr. | 343/702 |
| 5,835,064 | 11/1998 | Gomez et al. | 343/702 |

FOREIGN PATENT DOCUMENTS

| | | |
|---|---|---|
| 9-121178 | 5/1997 | Japan . |
| WO 96/27916 | 9/1996 | WIPO . |

*Primary Examiner*—Hoanganh Le
*Assistant Examiner*—Shih-Chao Chen
*Attorney, Agent, or Firm*—Winston Hsu

[57] ABSTRACT

This invention relates to a composite antenna used in a radio transceiver, which comprises a first antenna and a detachable antenna set. The first antenna can be used without the detachable antenna set for transmitting and receiving radio signals radiated from the radio transceiver. The detachable antenna set comprises a second antenna for transmitting and receiving radio signals and an antenna sheath electrically connected to the second antenna, for detachably attaching to the first antenna. When the antenna sheath is attached to the first antenna and electrically connected to the signal line and the ground port therein, radio signals transmitted or received by the radio transceiver are confined within the antenna sheath and can be transmitted or received through the second antenna of the detachable antenna set.

6 Claims, 2 Drawing Sheets

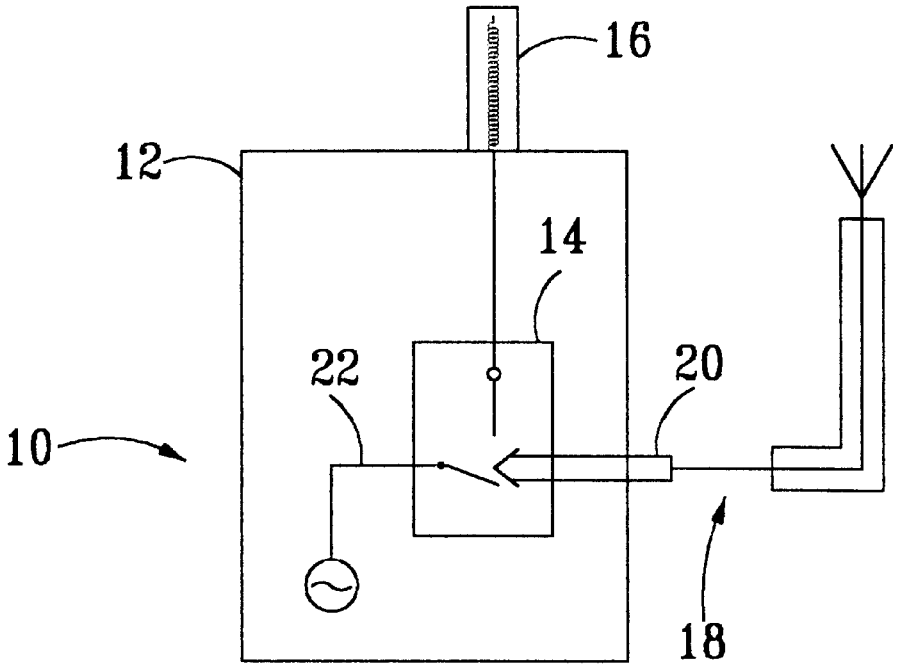
FIG. 1 PRIOR ART
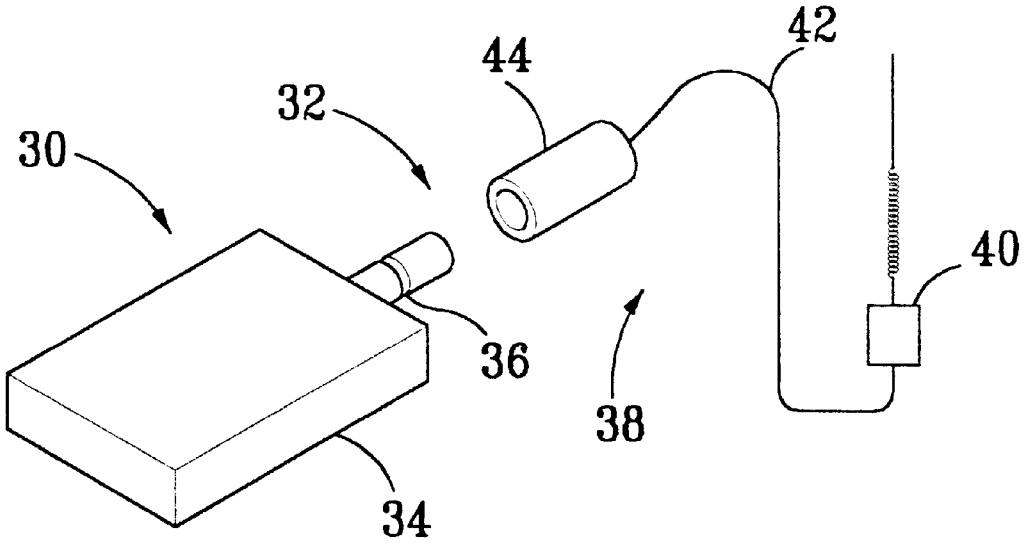
FIG. 2

COMPOSITE ANTENNA FOR RADIO TRANSCEIVERS

BACKGROUND OF THE INVENTION

1. Field of the Invention

This invention relates to an antenna, more particularly, to a composite antenna used in a radio transceiver.

2. Description of the Prior Art

Radio transceivers, such as mobile phones, are quite popular among people for their portability. When using a radio transceiver in a car, car antennas are used for enhancing the efficiency in radio transmission. Most radio transceivers are equipped with an internal antenna switch for selecting its own local antenna or the car antenna. When an antenna connector of a car antenna is connected to the antenna switch of a radio transceiver, the antenna switch will disconnect its local antenna so that radio signals can be transmitted through the car antenna instead of through its local antenna.

Please refer to FIG. 1. FIG. 1 shows a prior art radio transceiver 10 equipped with an antenna switch 14. The radio transceiver 10 comprises a housing 12 and an antenna switch 14 inside the housing 12 for connecting the radio transceiver 10 to a local antenna 16 or a car antenna 18. When the antenna connector 20 of the car antenna 18 is plugged into the antenna switch 14, the signal line 22 in the radio transceiver 10 will be electrically connected to the car antenna 18 so that the radio transceiver 10 can send or receive radio signals through the high efficient car antenna 18. When the antenna connector 20 of the car antenna 18 is disconnected with the antenna switch 14, the signal line 22 will be electrically connected to the local antenna 16. One drawback of the radio transceiver 10 is that it uses the antenna switch 14 to select its local antenna 16 or the car antenna 18. The antenna switch 14 increases the cost and the complexity of the radio transmission circuit of the radio transceiver 10.

SUMMARY OF THE INVENTION

It is therefore an objective of the present invention to provide a composite antenna which allows a radio transceiver to select its local antenna or a car antenna without using an antenna switch. Moreover, when choosing the car antenna, the composite antenna is in a tight connection with the car antenna so as to avoid unexpected separation and to maintain communication efficiency.

(1) a first antenna installed on the radio transceiver having a ground port, a signal line for transmitting and receiving radio signals, a plastic cover outside the signal line for protecting the signal line, the plastic cover having a top end and a bottom end, a circular grooved portion around the bottom end of the plastic cover, and a conductor installed on the circular grooved portion and electrically connected to the ground port; and (2) a detachable antenna set comprising:

(a) a second antenna for transmitting and receiving radio signals;

(b) an antenna sheath for detachably attaching to the first antenna, the antenna sheath comprising a first conducting layer for inhibiting the radio signals generated by the first antenna from radiating out when the antenna sheath is attached to the first antenna, the first conducting layer of the antenna sheath having a corresponding inward protruding edge for engaging with the grooved portion; and (c) a coaxial cable comprising:

a conducting line electrically connected to the second antenna for transmitting and receiving radio signals;

a dielectric layer covered outside the conducting line; and a second conducting layer covered outside the dielectric layer and electrically connected to the first conducting layer of the antenna sheath;

wherein when the antenna sheath of the detachable antenna set is attached to the first antenna, the conducting line of the coaxial cable is electrically connected to the signal line of the first antenna so that the radio transceiver can transmit or receive radio signals through the second antenna of the detachable antenna set, the first conducting layer of the antenna sheath is electrically connected to the ground port of the first antenna via the conductor on the grooved portion so that radio signals radiated from the signal line of the first antenna are confined within the antenna sheath, and the protruding edge of the first conducting layer is fixed onto the grooved portion so that the first antenna and the second antenna are firmly connected.

It is an advantage of the present invention that it provides a composite antenna over which when the detachable antenna set of the composite antenna is attached to the first antenna of the radio transceiver, the radio transceiver can transmit or receive radio signals through the detachable antenna set in high efficiency without using an antenna switch.

This and other objectives of the present invention will no doubt become obvious to those of ordinary skill in the art after having read the following detailed description of the preferred embodiment which is illustrated in the various drawings and figures.

BRIEF DESCRIPTION OF THE DRAWINGS

FIG. 1 is a diagrammatic view of a prior art radio transceiver equipped with an antenna switch.

FIG. 2 is a perspective view of a composite antenna in accordance with the present invention.

DETAILED DESCRIPTION OF THE PREFERRED EMBODIMENT

Figure 3:
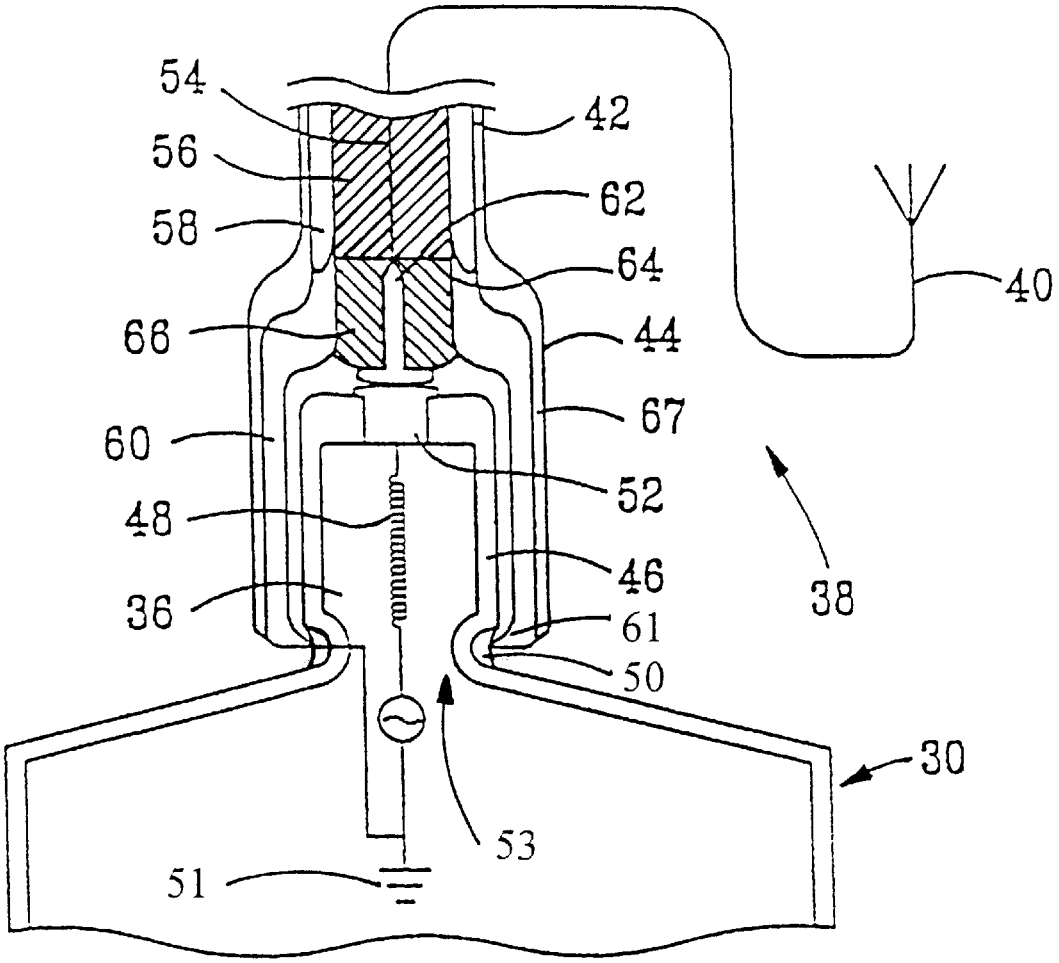
FIG. 3 is a sectional view of the composite antenna shown in FIG. 2 In this drawing the local antenna is attached to the antenna sheath of the detachable antenna set.

FIG. 2 is a perspective view of a composite antenna 32 in accordance with the present invention. The radio transceiver 30 comprises a housing 34 and a local antenna 36 installed on top of the housing 34 for transmitting and receiving radio signals. The composite antenna 32 comprises the local antenna 36 of the radio transceiver 30 and a detachable antenna set 38. The detachable antenna set 38 is usually installed in a car. The detachable antenna set 38 comprises an external antenna 40 for transmitting and receiving radio signals, an antenna sheath 44 for connecting the local antenna 36, and a coaxial cable 42 electrically connected the antenna sheath 44 with the external antenna 40 for transmitting and receiving radio signals.

FIG. 3 is a sectional view of the composite antenna 32 shown in FIG. 2. In this drawing the local antenna 36 is attached to the antenna sheath 44 of the detachable antenna set 38. The local antenna 36 comprises a ground port 51, a cylinder-shaped plastic cover 46, a signal line 48 installed in the plastic cover 46 for transmitting and receiving radio signals for the radio transceiver 30, a conductor 52 installed at the top end of the plastic cover 46 which is electrically connected to the signal line 48, a circular grooved portion 53 around the bottom end of the plastic cover 46, and a ring-shaped conductor 50 installed on the circular grooved portion 53. Both the signal line 48 and the ring shaped conducter 50 are electrically and respectively connected to the signal and ground ports of the radio transceiver 30. The plastic cover 46 is made of insulated material for protecting the signal line 48 inside.

The antenna sheath 44 of the detachable antenna set 38 is used for attaching the plastic cover 46 of the local antenna 36. The antenna sheath 44 comprises a cylinder-shaped first conducting layer 60 with an opening 64 on its top end, a conductor 62 installed inside the opening 64, an insulator 66 covered outside the conductor 62 for isolating the conductor 62 from the first conducting layer 60, and an insulating plastic cover 67 installed outside the first conducting layer 60 for protecting the antenna sheath 44. The first conducting layer 60 of the antenna sheath 44 is electrically connected to the ground port 51 of the local antenna 36 via the ring shaped conducter 50 when the antenna sheath 44 is physically attached to the local antenna 36 so that most radio signals radiated from the signal line 48 will be confined within the antenna sheath 44.

The first conducting layer 60 of the antenna sheath 44 has an inward protruding edge 61 for engaging with the circular grooved portion 53. When the antenna sheath 44 of the detachable antenna set 38 is attached to the local antenna 36, the protruding edge 61 of the first conducting layer 60 is fixed onto the grooved portion 53 so that the local antenna 36 and the external antenna 40 are firmly connected.

The coaxial cable 42 connected between the antenna sheath 44 and the external antenna 40 comprises a conducting line 54 which is electrically connected between the external antenna 40 and the conductor 62 of the antenna sheath 44 for transmitting and receiving radio signals, a dielectric layer 56 covered outside the conducting line 54, and a second conducting layer 58 which is covered outside the dielectric layer 56 and is electrically connected to the first conducting layer 60 of the antenna sheath 44.

When the antenna sheath 44 of the detachable antenna set 38 is attached to the local antenna 36, both the conductor 62 and the first conducting layer 60 of the antenna sheath 44 are electrically connected to the conductor 52 and the ground port 51 of the local antenna 36 separately so that most radio signals radiated from the signal line 48 will be confined within the antenna sheath 44. The plastic cover 46 of the local antenna 36 is used to isolate the signal line 48 of the local antenna 36 from the first conducting layer 60 of the antenna sheath 44.

Figure 4:
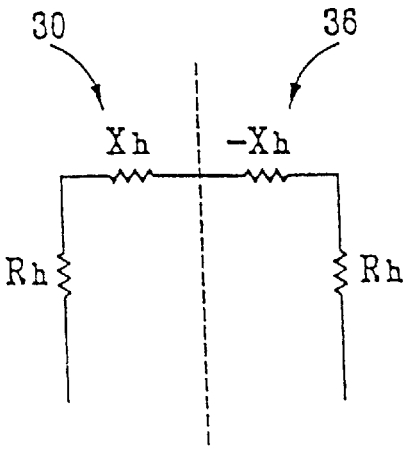
FIG. 4 is an equivalent output circuit schematic of the first antenna of the composite antenna.

FIG.4 is an equivalent circuit schematic of an output circuit (not shown) of the radio transceiver 30 and the local antenna 36. The output circuit can be a duplexer used in mobile phones. The impedance of the output circuit of the radio transceiver 30 is Rh+Xh, in which Rh and Xh are respectively the resistance and reactance of the transceiver 30. In a preferred embodiment the equivalent impedance of the local antenna 36 is designed to match the impedance of the radio transceiver 30 so that the transceiver and the local antenna can reach maximum transmitting/receiving efficiency, therefore the impedance of the local antenna 30 is Rh−Xh.

Figure 5:
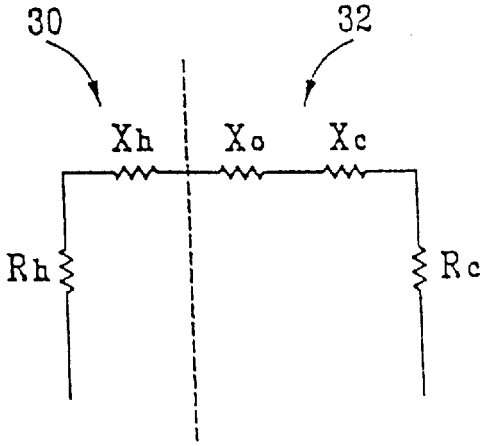
FIG. 5 is an equivalent output circuit schematic of the composite antenna.

FIG.5 shows the equivalent circuit schematic of the output circuit of the radio transceiver 30 and the composite antenna 32. When the antenna sheath 44 of the detachable antenna set 38 is attached to the local antenna 36, most radio signals radiated from the signal line 48 of the local antenna 36 will be confined within the antenna sheath 44. The local antenna 36 together with the attached antenna sheath 44 can therefore be taken as an extension of the coaxial cable 42. As shown in FIG. 5, the impedance of the output circuit of the radio transceiver 30 remains Rh+Xh, while the impedance of the composite antenna 32 is Rc+Xo+Xc, in which Rc is the resistance of the composite antenna 32, Xo is the new reactance of the local antenna 36, and Xc is the reactance of the detachable antenna set 38.

In designing the detachable antenna set 38, Rc and Xc should be chosen to meet the following two conditions in order to match the impedance of the composite antenna 21 with the output circuit of the radio transceiver 30 so that insertion loss and return loss of the output power can be reduced to the minimum:

$$Xh+Xo+Xc=0$$

$$Rh=Rc$$

Compared with the radio transceiver 10 shown in FIG. 1, the design of the composite antenna 32 obviates the need for an antenna switch in the radio transceiver 30 when attaching the antenna sheath 44 of the detachable antenna set 38 to the local antenna 36. Such design significantly simplifies the output circuit of the radio transceiver 30 and also avoids possible loss from the eliminated antenna switch.

Those skilled in the art will readily observe that numerous modifications and alterations of the device may be made while retaining the teaching of the invention. Accordingly, the above disclosure should be construed as limited only by the metes and bounds of the appended claims.

We claim:

1. A composite antenna used in a radio transceiver comprising:

(1) a first antenna installed on the radio transceiver having a ground port, a signal line for transmitting and receiving radio signals, a plastic cover outside the signal line for protecting the signal line, the plastic cover having a top end and a bottom end, a circular grooved portion around the bottom end of the plastic cover, and a conductor installed on the circular grooved portion and electrically connected to the ground port; and (2) a detachable antenna set comprising:

(a) a second antenna for transmitting and receiving radio signals;

(b) an antenna sheath for detachably attaching to the first antenna, the antenna sheath comprising a first conducting layer for inhibiting the radio signals generated by the first antenna from radiating out when the antenna sheath is attached to the first antenna, the first conducting layer of the antenna sheath having a corresponding inward protruding edge for engaging with the grooved portion; and (c) a coaxial cable comprising:

a conducting line electrically connected to the second antenna for transmitting and receiving radio signals;

a dielectric layer covered outside the conducting line; and a second conducting layer covered outside the dielectric layer and electrically connected to the first conducting layer of the antenna sheath;

wherein when the antenna sheath of the detachable antenna set is attached to the first antenna, the conducting line of the coaxial cable is electrically connected to the signal line of the first antenna so that the radio transceiver can transmit or receive radio signals through the second antenna of the detachable antenna set, the first conducting layer of the antenna sheath is electrically connected to the ground port of the first antenna via the conductor on the grooved portion so that radio signals radiated from the signal line of the first antenna are confined within the antenna sheath, and the protruding edge of the first conducting layer is fixed onto the grooved portion so that the first antenna and the second antenna are firmly connected.

2. The composite antenna of claim 1 wherein the plastic cover is further used for electrically isolating the signal line from the first conducting layer of the antenna sheath when the antenna sheath is attached to the plastic cover of the first antenna.

3. The composite antenna of claim 2 wherein the plastic cover of the first antenna is in a cylindrical shape.

4. The composite antenna of claim 3 wherein the first antenna further comprises a conductor installed at the top end of the plastic cover and electrically connected to the signal line wherein the conductor of the first antenna is electrically connected to the conducting line of the detachable antenna set when the antenna sheath of the detachable antenna set is attached to the plastic cover of the first antenna.

5. The composite antenna of claim 1 wherein the antenna sheath further comprises a conductor electrically connected to the conducting line of the coaxial cable and an insulator covered outside the conductor for isolating the conductor from the first conducting layer of the antenna sheath wherein when the antenna sheath is attached to the plastic cover of the first antenna, the conductor of the antenna sheath is electrically connected to the conductor of the first antenna.

6. The composite antenna of claim 1 wherein both the equivalent impedance of the first antenna when used without the detachable antenna set and the equivalent impedance of the composite antenna, match the impedance of the radio transceiver.

* * * * *